US008875809B2

(12) United States Patent
Mageren

(10) Patent No.: US 8,875,809 B2
(45) Date of Patent: Nov. 4, 2014

(54) CORE DRILL AND CORING METHOD

(75) Inventor: Olivier Jean-Marc Claude Mageren, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 457 days.

(21) Appl. No.: 13/388,090

(22) PCT Filed: Jul. 30, 2010

(86) PCT No.: PCT/BE2010/000056
§ 371 (c)(1),
(2), (4) Date: Jun. 21, 2012

(87) PCT Pub. No.: WO2011/011839
PCT Pub. Date: Feb. 3, 2011

(65) Prior Publication Data

US 2012/0261192 A1 Oct. 18, 2012

(30) Foreign Application Priority Data

Jul. 31, 2009 (BE) ..... PCT/BE2009/000042

(51) Int. Cl.

| | |
|---|---|
| ***E21B 25/00*** | (2006.01) |
| ***E21B 25/02*** | (2006.01) |
| ***E21B 25/06*** | (2006.01) |
| ***E21B 49/02*** | (2006.01) |

(52) U.S. Cl.
CPC ..... *E21B 25/06* (2013.01); *E21B 25/02* (2013.01); *E21B 49/02* (2013.01)
USPC ..... 175/58; 175/403; 175/244

(58) Field of Classification Search
CPC ..... E21B 25/00; E21B 25/005; E21B 25/02; E21B 25/05
USPC ..... 175/58, 403, 405.1, 239, 240, 244–255
See application file for complete search history.

(56) References Cited

U.S. PATENT DOCUMENTS

| | | | | |
|---|---|---|---|---|
| 1,857,693 | A * | 5/1932 | Quintrell | 175/249 |
| 2,093,633 | A | 9/1937 | Catland | 255/72 |
| 2,681,795 | A * | 6/1954 | Gregory | 175/309 |

(Continued)

FOREIGN PATENT DOCUMENTS

| | | |
|---|---|---|
| GB | 1803753 | 9/1967 |

OTHER PUBLICATIONS

International Search Report and Written Opinion, Application No. PCT/BE2010/000056, 10 pages, Dec. 15, 2010.

*Primary Examiner* — Blake Michener
(74) *Attorney, Agent, or Firm* — Baker Botts L.L.P.

(57) ABSTRACT

Disclosed is a core drill comprising: an external pipe; a coring bit to be rotated by rotation of the external pipe to drill a coring hole and form a core having a core diameter; and an internal coring pipe (1), mounted within the external pipe, to receive a core formed by the coring bit, the internal coring pipe comprising: an internal tubular wall (2) defining a cavity (4) having a diameter substantially the same as the core diameter within which to retain a core formed by the coring bit, one or more viewing openings (8, 9, 10) being formed through the internal tubular wall; and an external tubular wall (3), in which the internal tubular wall is housed coaxially, the internal and external tubular walls being connected to each other so as to form a single-piece double-walled pipe.

27 Claims, 3 Drawing Sheets

(56) References Cited

U.S. PATENT DOCUMENTS 2,876,996 A * 3/1959 Hildebrandt ..... 175/255
3,804,184 A 4/1974 Gusman et al. ..... 175/226
4,716,974 A 1/1988 Radford et al. ..... 175/59
7,347,281 B2 * 3/2008 Zastresek ..... 175/58

* cited by examiner

CORE DRILL AND CORING METHOD

CROSS REFERENCE TO RELATED APPLICATIONS

This application is a U.S. National Stage Application of International Application No. PCT/BE2010/000056 filed Jul. 30, 2010, which designates the United States and claims the benefit of International Application No. PCT/BE2009/000042 filed Jul. 31, 2009, which also designates the United States, and which are incorporated herein by reference in their entirety.

The present invention relates to a core drill and an associated coring method.

A core drill, for example intended for oil prospecting, comprises in a known manner an annular coring bit, an external pipe that supports the annular core bit and rotates it and an internal coring pipe intended to receive the core. The internal coring pipe is housed coaxially inside the external pipe, for example by means of a roller bearing that enables the external pipe to drive the internal pipe axially and to rotate about it without driving it in rotation. In a known manner, several external pipes and several internal pipes can be assembled in succession in the form of a pipe string. The anterior internal pipe, considering the direction of travel of the drill while the core is being cut, carries in a usual manner a normal split frustoconical ring system intended to hold the core in the cavity of the internal pipe string while the latter is being raised towards the surface.

Drills that core of the type described above have been known for a long time.

When it is necessary to examine the core collected by means of such drills, it can be difficult to extract the core from the internal pipe without damaging it.

Thus, several attempts have been made to improve the extraction of the core with a view to examination of the core at the surface. Provision has, for example, been made to form the internal pipe from two semi-cylinders clamped one against the other or even locked one on the other (see for example U.S. Pat. No. 7,182,155 and US-A-2008/0083645). These systems do, however, have several drawbacks. Either, the half-tubes are assembled by simply being applied one against the other and, in this case, relative movements between the two elements, whether it be during coring or during opening, may disturb the integrity of the core; or, the half-tubes are assembled by snap-on systems that it is then necessary to disengage, which can give rise to complicated and violent manipulations of the internal pipes with the possibility of contaminating or disturbing the core.

Another example is an internal pipe has also been provided that encloses in its cavity, while holding it firmly, a tubular jacket. This is intended to receive the core and has a prefashioned parting line, for example through the arrangement of scored inline perforations. Once on the surface, the tubular jacket must first of all be slipped out of the internal pipe and then be opened by disassembling the sections of the pipe along the parting lines (see U.S. Pat. No. 7,347,281).

All these devices have the drawback that, on the surface, it is not possible to view the core without manipulating the internal pipe prior to opening it. This opening step, even if it is improved with respect to the current technique, which consists of sawing the internal pipe, does not always absolutely guarantee the maintenance of the integrity of the core during this operation. Finally, in these devices, the coring fluid is discharged along the core, between the core and the internal pipe. In certain frequent cases, the fluid situated above the core cannot pass along the core, which can block entry or advancement of the core into the internal pipe of the drill.

It can moreover be noted that, for the purpose of improving the circulation of the coring fluids in a drill, an arrangement of three independent concentric pipes has already been provided. That is to say, a middle pipe has been disposed coaxially between the external pipe and a conventional internal pipe, so as to form flow spaces between the three pipes (see, for example, WO 97/26438 and BE-A-1011199).

A coring method is also known comprising: cutting a core in a coring hole using a coring bit; and introducing this core into at least one internal core drill pipe comprising an internal tubular wall, in which the core is received and which is provided with at least one open slot, and an external tubular wall, in which the internal tubular wall is housed coaxially, the internal and external tubular walls being held radially at a distance from each other and connected to each other so as to form a single-piece assembly (see for example U.S. Pat. No. 4,716,974).

During the coring method described in this prior art, an annular free space situated between the external and internal tubular walls is completely filled with a liquid foam that is then hardened before bringing the core to the surface.

In order to allow the use of the foam in this way, the core cut by the coring bit must have a diameter somewhat smaller than the internal diameter of the internal tubular wall, in order that, when the core is received within the internal tubular wall, a surrounding annular space is created around the core, into which the liquid foam can be charged.

The (outer) diameter of a core cut by a core drill will be determined by the coring bit used to cut it. However, the diameter of a core may not correspond directly to the inner diameter of the body of the coring bit used to cut it; for example, the coring bit may include cutting teeth which inscribe a circle of smaller diameter that the supporting body of the coring bit in which the teeth are held. As such, for present purposes, a coring bit may most suitably be characterised in terms of the diameter of the core that it will cut.

The construction of the internal drill core pipe in U.S. Pat. No. 4,716,974 is provided solely to facilitate the foaming process for recovering the core to the surface without fluid loss, migration or wipe. As such, the process of disassembly to examine the core is not described and can therefore be considered to be performed in the usual manner, with all the aforementioned disadvantages.

According to a first aspect of the present invention, there is provided a coring method, comprising: receiving a core to be examined within at least one internal coring pipe, the internal coring pipe comprising: an internal tubular wall defining a cavity in which the core is retained and having one or more viewing openings formed in the internal tubular wall; and an external tubular wall, in which the internal tubular wall is housed coaxially, the internal and external tubular walls being connected to each other so as to form a single-piece double-walled pipe; removing part of the external tubular wall to expose at least one of the one or more viewing openings; and viewing the core retained substantially in tact within the internal tubular wall through the at least one exposed viewing opening.

Embodiments of the present invention are able to provide a coring method that does not have the aforementioned drawbacks of the prior art and avoids, in particular, the complexity of assembly and dismantling of the drill with the associated risk of jamming of the core, the risk of damage to the core during manipulations and dismantling, and the risk of direct contact of tools and the like with the core during the opening of the internal pipe. Ideally, embodiments of the invention can also provide certain and rapid viewing of the core on the surface.

According to a second aspect of the present invention, there is provided a core drill comprising: an external pipe; a coring bit to be rotated by rotation of the external pipe to drill a coring hole and form a core having a core diameter; and an internal coring pipe, mounted within the external pipe, to receive a core formed by the coring bit, the internal coring pipe comprising: an internal tubular wall defining a cavity having a diameter substantially the same as the core diameter within which to retain a core formed by the coring bit, one or more viewing openings being formed through the internal tubular wall; and an external tubular wall, in which the internal tubular wall is housed coaxially, the internal and external tubular walls being connected to each other so as to form a single-piece double-walled pipe.

In this arrangement, the core comes into contact solely and intimately with the internal tubular wall. It is therefore possible to manipulate the external tubular wall without danger to the integrity of the core. It is even possible to cut or saw the external tubular wall completely or partially. As the two tubular walls form a single-piece assembly, they can be manufactured in one piece. The distance that separates them allows the formation of annularly disposed spaces through which the coring fluid can preferentially flow, without having to pass along the core. At the time of disconnection, these spaces are still empty, which allows direct viewing of the core contained within the internal tubular wall, when part of the external tubular wall has been cut away, or otherwise disconnected and then removed, through the viewing opening provided on the internal tubular wall. Transporting the internal coring pipe containing a core, which is without danger of damage or contamination to the core, remains possible even after this partial removal of the external tubular wall. This is because the core remains held inside the internal tubular wall. The disconnected and then detached external wall part, or the space it leaves in the external tubular wall, may have any shape. For example, it may be a segment of a cylinder that extends longitudinally from one end to the other of the internal pipe, or it may take the form of a window in the external tubular wall.

According to one embodiment of the invention, the said step of disconnecting part of the external tubular wall of the internal pipe takes place facing one of the said at least one slot that thus forms the said core viewing opening, during the step of detaching the disconnected external tubular wall part. Such an open slot can advantageously, but not necessarily, extend longitudinally from one end to the other of the said internal tubular wall. It thus allows viewing of the complete length of core in the still enclosed (retained) state in the internal tubular wall, which is to say the core remains, despite the opening of the external tubular wall, not contaminated, nor disturbed in its integrity.

In further embodiments of the invention, at least one scoring line may be provided towards the outside, on the external tubular wall, for example longitudinally. This line facilitates the partial removal of the external tubular wall by reducing, for example, the thickness of the wall to be cut. It can also serve as an external mark for locating the position of the viewing opening or a slot in the internal tubular wall.

The disconnection or removal can include or use cutting, sawing or any other means.

In further embodiments of the invention, the internal and external tubular walls are held radially a distance apart and are connected to each other by struts that preferably extend longitudinally parallel to each other. The internal tubular wall may comprise at least two open slots that are circumferentially disposed at a distance from each other and extend longitudinally from one end to the other of the said internal tubular wall. At least one strut is preferably provided in every gap between two adjacent ones of the said at least two open slots.

The disconnected external tubular wall part may have circumferentially a first longitudinal edge situated approximately facing a first of the said at least two open slots and a second longitudinal edge situated approximately facing a second of the said at least two open slots. When this disconnected external tubular wall part is detached from the said internal coring pipe, an internal tubular wall part situated between the said first open slot and the said second open slot which is connected to the said disconnected external tubular wall part by at least one of the said struts is detached along with the disconnected external tubular wall part, thereby forming the said viewing opening. The struts preferably extend longitudinally between the internal and external tubular walls, delimiting several empty longitudinal passages allowing fluid to circulate between an upstream end and a downstream end of the internal coring pipe.

Where there are two open slots extending from one end of the internal tubular wall to the other, two separate cylinder segments are formed. These are however held firmly in place with respect to each other by the struts secured to the external tubular wall. During the detachment (separation) step, one of the aforementioned cylinder segments is removed since it is kept integral with the detached external tubular wall part. The opening thus formed assumes no manipulation or contamination detrimental to the core, which remains retained, enclosed in the other cylinder segment of the internal tubular wall.

Provision can also be made for the internal coring pipe to comprise fixing means or end connectors for connecting it to at least one other internal coring pipe, these fixing means being provided on the external tubular wall of each of the internal coring pipes to be connected. These fixing means make it possible to arrange an internal coring pipe string inside the external pipe or pipes of the core drill.

Other particularities of the core drill and the coring method of the invention are indicated in the dependent claims.

Other details and particularities of the invention will emerge from the description given below of non-limiting example embodiments. This description is made with reference to the accompanying drawings, in which:—

In the various drawings, identical or similar elements bear the same reference numbers.

Figure 1:
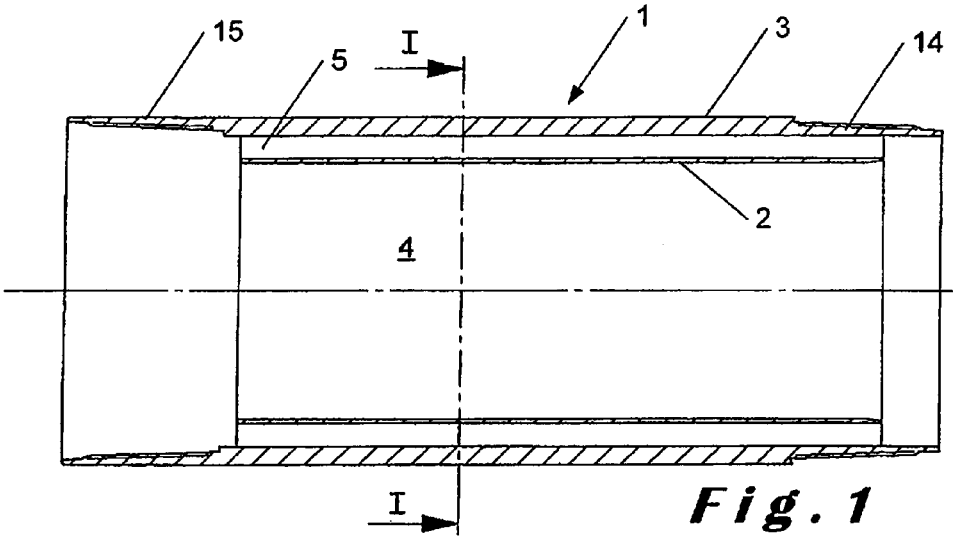
FIG. 1 shows a view in axial section of an internal coring pipe for use in a core drill and coring method according to the present invention.
Figure 2:
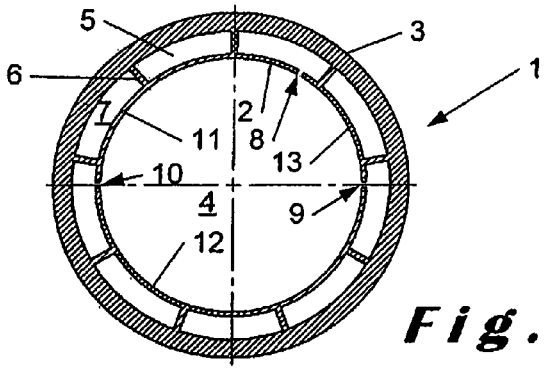
FIG. 2 shows a view in transverse section along the line I-I in FIG. 1.

As is clear from FIGS. 1 and 2, illustrating an example of an internal coring pipe 1 which may be used in a core drill or coring method according to the invention, the internal coring pipe 1 is designed in the form of a double-wall pipe. It comprises an internal tubular wall 2 and an external tubular wall 3. The internal tubular wall 2 is intended to receive the core in its cavity 4. It is housed coaxially inside the external tubular wall 3 while being held radially at a distance therefrom so as to form an annular space 5 between the internal and external tubular walls. As can be seen in particular in FIG. 2, the tubular walls 2 and 3 are connected to each other firmly, thus forming a single-piece assembly.

The illustrated internal coring pipe can advantageously be produced from a material being or based on a metal or plastics material. It is advantageously possible to provide for manufacture by extrusion so as to form the double-wall pipe in one piece. There can then be envisaged, preferably, as the material, aluminium or an aluminium alloy, or possibly certain extrudable plastics materials.

In the illustrated example, the tubular walls 2 and 3 are connected to each other and held radially, concentrically, a distance apart by struts 6 that extend longitudinally between them. These struts 6 thus delimit, in the annular space 5, longitudinal passages 7 that allow a circulation of coring fluid between the upstream and downstream ends of the internal coring pipe 1.

According to the illustrated example, the internal tubular wall 2 is provided with three open slots disposed facing the arrows 8, 9 and 10 in FIG. 2. These slots are circumferentially arranged at a distance from one another. The slots 9 and 10 are disposed at 180° from each other, and the slot 8 is disposed at an angle from the slot 9 that is less than 180°, which may be, for example, about 15°, 30°, 45° or 60°, and here is approximately 30°. In this example, the slots 8 to 10 extend longitudinally from one end of the internal tubular wall 2 to the other and thus form three cylinder segments 11, 12 and 13. Each of these cylinder segments is held so as to be fixed to the external tubular wall 3 by one or, as illustrated here, several struts 6. According to this arrangement the cylinder segments 11 to 13 are therefore completely fixed together, without any possibility of relative movement between them during the coring or during the steps of bringing up the core. In the example illustrated, the struts 6 also extend entirely from one end of the internal tubular wall 2 to the other, i.e., the three cylinder segments 11, 12 and 13 are not directly connected to each other.

In the example illustrated, the internal coring pipe 1 has fixing means intended to connect several internal coring pipes to one another. The external tubular wall 3 has end sections 14 and 15 that project axially on either side of the internal tubular wall. The fixing means are provided on these sections. The downstream end section 14 is in the form of a male coupling that thins and has an external thread. The upstream end section 15 is in the form of a female coupling that splays and has an internal thread. The possibility can be envisaged of directly screwing the male coupling of an internal coring pipe 1 to the female coupling of another internal coring pipe 1.

Figure 3:
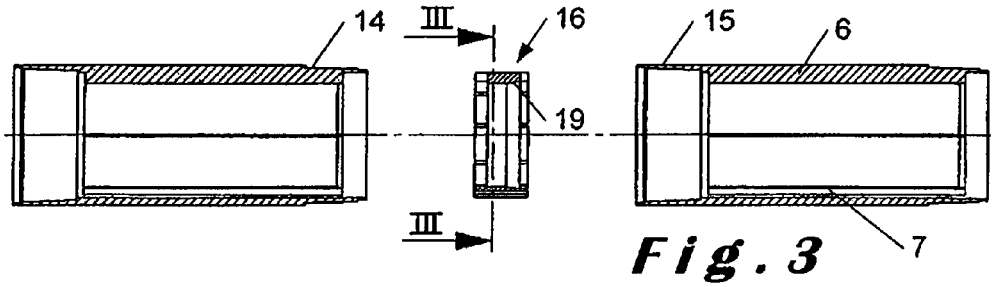
FIG. 3 shows an exploded view of the assembly of two internal coring pipes for use in a core drill and coring method according to the present invention.
Figure 4:
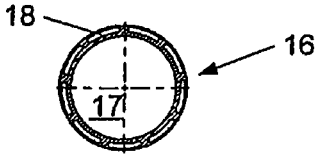
FIG. 4 shows a view in section, along the line in FIG. 3, of a spacing ring.

Given that these threaded couplings have manufacturing tolerances that sometimes might cause misalignment of the internal coring pipes, and consequently a risk of blocking of the core migrating upwards inside the internal coring pipe string, it may be advantageous to make provision, between two internal coring pipes, for connecting a spacing ring 16, such as for example the one illustrated in FIGS. 3 and 4.

As is clear from FIG. 3, before connecting two internal coring pipes to each other, a spacing ring 16 is inserted between them. In the fixing position, the spacing ring 16 is then housed with regard to a first part inside the end section 14 of the external tubular part of a first internal coring pipe and with regard to a second part inside the end section 15 of the external tubular wall of a second internal coring pipe.

In FIG. 3 the axial section is selected so as, in the bottom parts of the internal coring pipes to be connected, to pass through longitudinal passages 7, while, in the top parts, to pass through the internal and external tubular walls at struts 6.

In the fixing position of the internal coring pipes, the spacing ring is gripped axially between the internal tubular walls of the internal coring pipes. The spacing ring 16 has an axial cavity 17 and circumferential passages 18 that allow for communication of fluid between the longitudinal passages 7 provided between the external and internal tubular walls of the two internal coring pipes connected together.

Advantageously, the axial cavity 17 has, on the downstream side, a splay 19 in the form of a bevel. In this way, blocking of the core during its upward migration in the internal coring pipe 1 is prevented in an improved manner.

Although not separately illustrated, as described earlier, in order to carry out a coring operation, the internal coring pipe 1 is (or, as the case may be, the interconnected string of internal coring pipes are) mounted within the external pipe of a core drill. The internal coring pipe is housed coaxially inside the external pipe, for example by means of a roller bearing that enables the external pipe to drive the internal pipe axially and to rotate about it without driving it in rotation. In a known manner, the external pipe may be formed as a string of external pipe sections, similarly to the internal core pipe string described above. The anterior (downstream) internal pipe, considering the direction of travel of the drill while the core is being cut, carries in a usual manner a normal split frustoconical ring system intended to hold the core in the cavity of the internal pipe string while the latter is being raised towards the surface.

A coring bit, typically an annular coring bit, is supported at or near the downstream end of the external pipe, and is driven in rotation by rotation of the external pipe. When used to extract a formation core, rotation of the coring bit, along with the necessary axial force, causes the bit to cut an annular hole into the formation, leaving a core cut out at the centre of the hole. As the coring bit advances into the formation, the core is received in the inner cavity 4 within the inner tubular wall 2 of the internal coring pipe 1, and advances upstream, relatively, within the internal coring pipe as the core bit advances downstream into the formation.

The core to be received within the internal coring pipe 1 should have substantially the same diameter as the cavity 4 within the inner tubular wall 2 of the coring pipe 1. That is, the core cut by the coring bit will be a close fit within the internal tubular wall 2 so as to leave substantially no gap between the core and the internal tubular wall 2. The core and internal tubular wall 2 are preferably in intimate contact around the inner circumference of the internal tubular wall 2, such that coring fluids above (upstream of) the core will be displaced upwards in the cavity 4, or through slots 8, 9 and 10, to pass downstream to the coring bit along longitudinal passages 7. The coring fluids will not freely pass downstream between the core and the internal tubular wall 2, if at all.

This is achieved by selecting a coring bit that cuts cores of a diameter substantially the same as the internal diameter of the inner tubular wall 2. The skilled person can readily select the appropriate coring bit, allowing for machining tolerances and wear of the coring bit, non-uniformity in the cross-sectional shape of the internal tubular wall 2, and the need for the core to be able to be received in and advanced through the cavity 4 within the internal tubular wall 2 without breaking or jamming. A close fit of the core within the internal tubular wall 2 helps to ensure that the core, once received within the internal tubular wall 2, is held securely in place with its integrity in tact.

In the above description, the terms upstream and downstream are to be understood according to the coring direction. An upstream side or end of an element is therefore the one that is closest to the surface to which the core is to be recovered and a downstream side or end is the one that is closest to the bottom of the coring hole, i.e toward the center of the earth.

Figure 5:
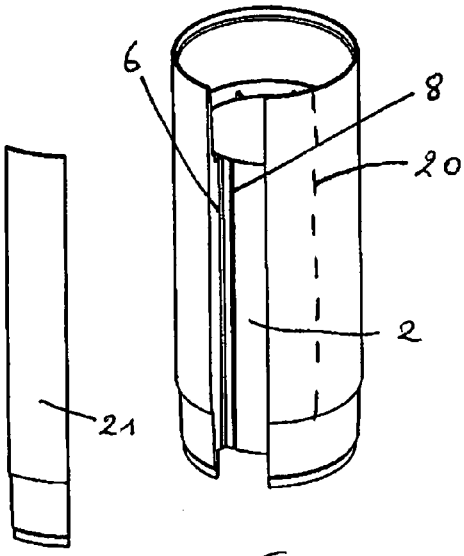

Once the coring has ended, the internal coring pipe or pipes 1 are brought to the surface. It is then possible to remove all or preferably part of the external tubular wall 3, without risk of damaging the integrity of the core held in the internal tubular wall 2. It is even possible to use, for this purpose, normal disconnection techniques, such as sawing the external tubular wall 3. Advantageously, one or more scoring lines 20 can be provided, extending longitudinally on the external tubular wall 3, as illustrated in FIG. 5. These lines can consist, for example, of a linear or isolated weakening of the wall or a linear perforation of the latter.

Alternatively, for the purposes simply of gaining access to the core for the purposes of immediately viewing the core, a part or parts of the outer tubular wall 3 may be removed by cutting away the material facing one of the slots 8, 9 or 10, for example by using a suitably wide saw blade or by drilling one or more holes.

In the example embodiment illustrated in FIG. 5, a section of the external tubular wall 3 is cut out, facing the longitudinal slot 8 and between two adjacent struts 6, so as to disconnect a cylindrical segment 21 of the external tubular wall 3. This cylindrical segment 21 is or can then be detached from the internal coring pipe 1. This makes it possible to view the core directly through the longitudinal slot 8, like a gauge intended to evaluate the content of a liquid reservoir. This operation in no way destroys the integrity of the core, which remains intact, held within the internal tubular wall 2. The core can then be transported and directed to a suitable subsequent processing unit, in its original packaging (i.e., the internal tubular wall 2). It can be remarked here how the internal double-wall coring pipes 1 according to the present disclosure have a high rigidity. This is particularly advantageous when the internal coring pipes are placed on the ground, horizontally, after they have been extracted from the coring hole vertically. During this operation, there exists the risk of core breakages caused by bending of the internal coring pipes of the prior art single-wall type.

Figure 6:
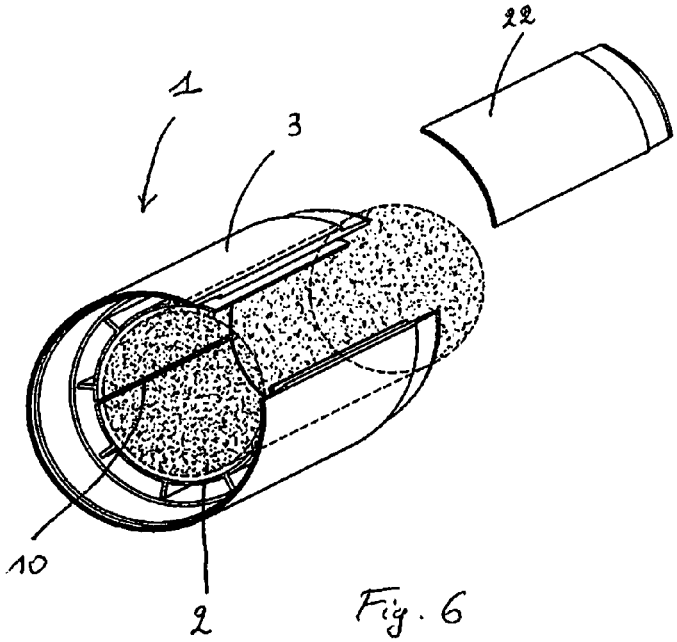
FIGS. 5 to 7 illustrate three processes of cutting an internal coring pipe, which may be a step in the coring method according the present invention.

In the example embodiment illustrated in FIG. 6, a cylinder segment 22 is cut from the external tubular wall 3 at a position facing the open slots 8 and 9 that are offset by an angle of approximately 30°. When the cylinder segment 22 is extracted from the external wall 3, the cylinder segment 13 of the internal wall (see FIG. 2), which for its part is connected to the segment 22 by struts 6, is removed simultaneously. It is not necessary to cut or saw the internal tubular wall 2, or to touch it with a tool, since the internal tubular wall 2 is already formed from several independent cylinder segments 11, 12 and 13. Removing one of these segments therefore disturbs the core, if at all, only to a particularly small extent, while allowing direct and easy viewing of the core.

Figure 7:
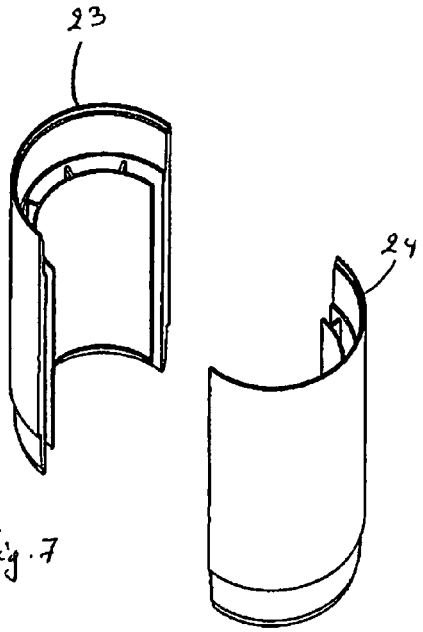

In the example embodiment illustrated in FIG. 7, the external tubular wall is cut facing each of the open slots 9 and 10 that are offset by 180°. In this way, one half 23 of the internal coring pipe 1 can be separated from the other half 24, once again without risk of touching and disturbing the integrity of the core with the saw or other cutting tool. One half of the internal tubular wall 2 previously divided by the open slots 9 and 10 accompanies each half of the cut external tubular wall 3, by virtue of the presence of the struts 6. It is then possible to take a sample of the core, the integrity of which has been preserved.

As can be seen by means of all these examples, when the disconnected part of the external tubular wall 3 is removed or detached, viewing of the core through a viewing opening, such as slots 8, 9 and 10, produced in the internal tubular wall 2 is direct, since the spaces existing between the internal tubular wall 2 and external tubular wall 3 are empty.

It must be understood that the present invention is in no way limited to the examples described above, and that many modifications can be made within the scope of the accompanying claims.

Figure 8:
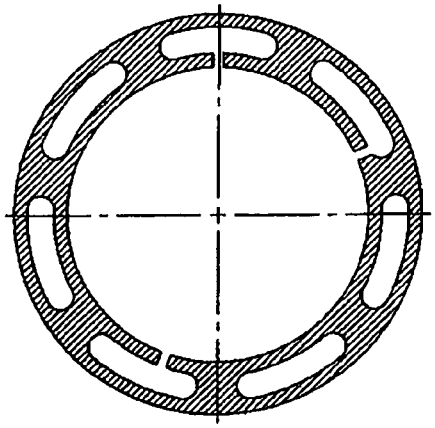
FIGS. 8 to 11 illustrate, in transverse section, four variants of an internal coring pipe for use in core drills or coring methods according to the present invention.
Figure 9:
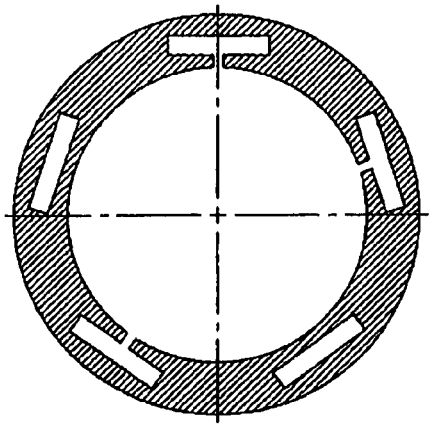

It can, for example, be envisaged that the open slots 8, 9 and 10 have various forms, be discontinuous along the internal tubular wall 2 of the internal coring pipe 1, or do not extend from one end to the other of the internal tubular wall 2. Likewise the longitudinal passages 7 allowing circulation of the coring fluid can have various shapes in transverse section, for example oblong, rectangular, circular, V-shaped or others (see for example FIGS. 8 and 9). Provision can also be made for the struts 6 not to be continuous along the internal coring pipe.

Provision can also be made for certain longitudinal passages to serve for housing electronic or electromechanical elements, for example sensors for monitoring the coring operation remotely.

Figure 10:
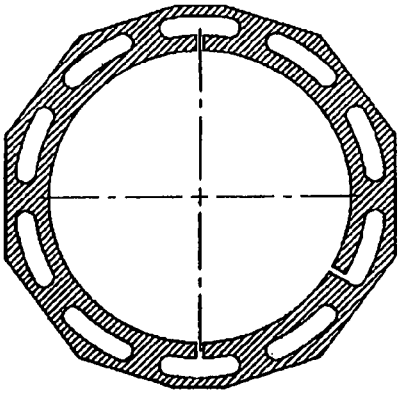

In transverse section, the external form of the internal tubular wall or the internal form of the external tubular wall, or both, may be different from a circular shape, and, for example, may be square, polygonal or otherwise non-circular (see for example FIG. 10).

The internal coring pipes can be connected together by fixing means other than threaded couplings. It is possible, for example, to imagine the use of spring clamps or clamping jaws or any other means known for this purpose.

Figure 11:
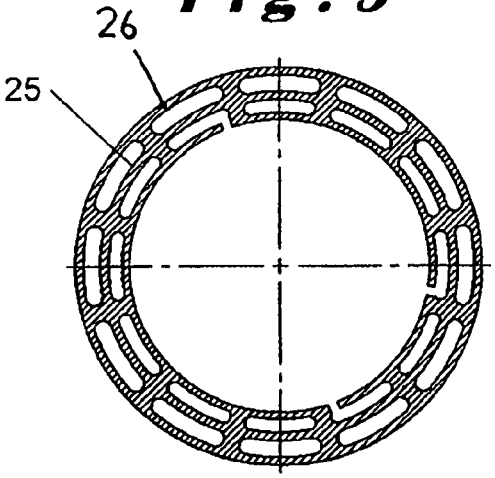

It can also be imagined that the external tubular wall 3 of the internal coring pipe 1 may have a multilayer structure (see, for example, FIG. 11). In this case, the outer tubular wall comprises, in addition to an external jacket 26, at least one intermediate tubular jacket 25, these jackets being in their turn held concentrically and radially at a distance from each other, while being connected together so as to form a single-piece assembly.

The invention claimed is:

1. A coring method, comprising:

receiving a core to be examined within at least one internal coring pipe, the internal coring pipe comprising:

an internal tubular wall defining a cavity in which the core is retained and having one or more viewing openings formed in the internal tubular wall; and an external tubular wall in which the internal tubular wall is housed coaxially, the internal and external tubular walls being connected to each other so as to form a single-piece double-walled pipe; and removing part of the external tubular wall to expose at least one of the one or more viewing openings; and viewing the core retained substantially intact within the internal tubular wall through the at least one exposed viewing opening.

2. The method according to claim 1, wherein the step of removing part of the external tubular wall comprises:

disconnecting the part of the external tubular wall; and separating the disconnected part from the internal coring pipe.

3. The method according to claim 2, wherein disconnecting the part of the external tubular wall includes cutting or sawing the external wall.

4. The method according to claim 1, wherein:

the one or more viewing openings include a slot in the internal tubular wall; and the part of the external tubular wall that is removed is removed from a place facing the slot to form one of the one or more viewing openings.

5. The method according to claim 1, wherein the internal tubular wall comprises at least two longitudinally extending slots that are circumferentially disposed a distance apart from each other to define a segment of the internal tubular wall between the two slots, the segment of the internal tubular wall being connected to the part of the external tubular wall that is removed such that, when that part of the external tubular wall is removed, the segment of the internal tubular wall connected thereto is also removed to expose a hole in the internal tubular wall corresponding to the removed segment and form one of the one or more viewing openings.

6. The method according to claim 1, wherein the internal and external tubular walls are held radially at a distance from each other and are connected to each other by struts that extend longitudinally between the tubular walls.

7. The method according to claim 1, wherein the part of the external tubular wall that is removed is removed by disconnecting the part along at least one scoring line that indicates the part of the external tubular wall to be removed and facilitates in disconnecting the part from the external tubular wall.

8. The method according to claim 1, further comprising extracting a sample from the core through the exposed viewing opening.

9. The method according to claim 1, further comprising transporting the viewed core retained within the internal tubular wall.

10. The method according to claim 1, wherein the internal coring pipe is part of a core drill and the core is received in the internal coring pipe during drilling of a core hole, by which the core is formed, using the core drill.

11. The method according to claim 10, wherein the core has a diameter substantially the same size as the internal diameter of the internal tubular wall such that, when the core is received in the internal coring pipe, substantially no gap is formed between the core and the internal tubular wall.

12. The method according to claim 1, wherein the core is received in the internal coring pipe downhole and is recovered to the surface in the internal coring pipe before removing the part of the external tubular wall.

13. The method according to claim 1, wherein the internal coring pipe forms part of an internal coring pipe string.

14. The method according to claim 13, further comprising assembling and/or disassembling the internal coring pipe string.

15. A core drill comprising:

an external pipe;

a coring bit configured to be rotated by rotation of the external pipe to drill a coring hole and form a core having a core diameter; and an internal coring pipe mounted within the external pipe to receive a core formed by the coring bit, the internal coring pipe comprising:

an internal tubular wall defining a cavity having a diameter substantially the same as the core diameter within which to retain a core formed by the coring bit, the internal tubular wall including one or more viewing openings formed through the internal tubular wall; and an external tubular wall in which the internal tubular wall is housed coaxially, the internal and external tubular walls being connected to each other so as to form a single-piece double-walled pipe.

16. The core drill according to claim 15, wherein the internal tubular wall comprises two or more longitudinally extending slots that are circumferentially disposed at a distance from each other.

17. The core drill according to claim 16, wherein two of the slots are circumferentially disposed at approximately 180° apart from each other.

18. The core drill according to claim 16, wherein at least one of the slots extends longitudinally from one end of the internal tubular wall to the other end.

19. The core drill according to claim 15, further comprising at least one scoring line extending longitudinally on the external tubular wall, the scoring line indicating a location where the external tubular wall should be cut to expose one of the one or more viewing openings.

20. The core drill according to claim 15, wherein the internal and external tubular walls are connected by struts that extend longitudinally between the internal and external tubular walls and define longitudinal passages that enable circulation of fluid between an upstream end and a downstream end of the internal coring pipe.

21. The core drill according to claim 20, wherein:

the internal tubular wall is divided into two or more segments by two or more slots extending longitudinally from one end of the inner tubular wall to the other end, and at least one of the struts exists between each segment and the outer tubular wall.

22. The core drill according to claim 15, wherein the internal coring pipe is part of a coring pipe string assembled from a plurality of internal coring pipes connected together by end connectors at the ends thereof.

23. The core drill according to claim 22, wherein a spacing ring is provided between two adjacent internal coring pipes of the coring pipe string, the spacing ring being housed inside the interconnected end connectors of the adjacent internal coring pipes.

24. The core drill according to claim 23, wherein the spacing ring provides circumferential passages that allow communication of fluid between longitudinal passages provided between the external and internal tubular walls of each of the two adjacent internal coring pipes.

25. The core drill according to claim 24, wherein the spacing ring is provided with an axial cavity through which the core formed by the coring bit is received, the spacing ring including a splay on the downstream side.

26. The core drill according to claim 15, wherein the single-piece double-walled pipe is an assembly formed by connecting separate components of the pipe together.

27. The core drill according to claim 15, wherein the single-piece double-walled pipe is extruded, or otherwise formed, as a single component having a unitary body including the internal tubular wall, the external tubular wall and the connections between the internal and external tubular walls.

* * * * *